US009671710B2

(12) United States Patent
Sun et al.

(10) Patent No.: US 9,671,710 B2
(45) Date of Patent: Jun. 6, 2017

(54) TONER FORMULATION USING CRYSTALLINE POLYESTER ENCAPSULATED WITH A STYRENE ACRYLATE LATEX FORMULATION AND METHOD OF PREPARING THE SAME

(71) Applicant: LEXMARK INTERNATIONAL, INC., Lexington, KY (US)

(72) Inventors: Jing X Sun, Lexington, KY (US); Cory Nathan Hammond, Winchester, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 14/937,282

(22) Filed: Nov. 10, 2015

(65) Prior Publication Data

US 2017/0131653 A1 May 11, 2017

(51) Int. Cl.

| | |
|---|---|
| ***G03G 9/09*** | (2006.01) |
| ***G03G 9/093*** | (2006.01) |
| ***G03G 9/08*** | (2006.01) |

(52) U.S. Cl.

CPC ..... *G03G 9/09392* (2013.01); *G03G 9/0806* (2013.01); *G03G 9/09357* (2013.01)

(58) Field of Classification Search

CPC ..... G03G 9/09392; G03G 9/0825
USPC ..... 430/110.2, 137.14
See application file for complete search history.

(56) References Cited

U.S. PATENT DOCUMENTS

| | | | | |
|---|---|---|---|---|
| 6,531,254 | B1 | 3/2003 | Bedells | |
| 6,531,256 | B1 | 3/2003 | Bedells | |
| 7,923,191 | B2 | 4/2011 | Bertelsen | |
| 8,669,035 | B2 | 3/2014 | Sun | |
| 9,023,569 | B2 | 5/2015 | Sun | |
| 2007/0134577 | A1* | 6/2007 | Tong | G03G 9/0804 430/108.1 |
| 2008/0063966 | A1 | 3/2008 | Mattison | |
| 2008/0182190 | A1 | 7/2008 | Arakawa | |
| 2009/0011352 | A1 | 1/2009 | Cooper | |
| 2009/0087765 | A1 | 4/2009 | Kidokoro | |
| 2011/0003242 | A1 | 1/2011 | Hayashi | |
| 2012/0052430 | A1 | 3/2012 | Yamasaki | |
| 2012/0288789 | A1* | 11/2012 | Mahabadi | C08J 3/126 430/108.2 |
| 2013/0171553 | A1* | 7/2013 | Sun | G03G 9/09328 430/108.6 |
| 2013/0244157 | A1* | 9/2013 | Inoue | G03G 9/0812 430/105 |
| 2014/0045116 | A1* | 2/2014 | Agur | G03G 9/0804 430/137.11 |
| 2014/0349231 | A1* | 11/2014 | Shirai | G03G 9/0825 430/109.4 |

* cited by examiner

*Primary Examiner* — Christopher Rodee

(57) ABSTRACT

The present disclosure relates to a chemically prepared toner composition including a toner particle having a core including a first polymer binder, an styrene acrylic encapsulated crystalline polyester latex, a pigment, a wax, and a shell formed around the core including a second polymer binder and method to make the same. The disclosed method of preparing the toner results in a change in the distribution of the components of the toner particle wherein the lower molecular weight resins, the pigment, and the wax are located away from the surface of the toner particle.

13 Claims, 2 Drawing Sheets

TONER FORMULATION USING CRYSTALLINE POLYESTER ENCAPSULATED WITH A STYRENE ACRYLATE LATEX FORMULATION AND METHOD OF PREPARING THE SAME

CROSS REFERENCES TO RELATED APPLICATIONS

None

BACKGROUND

1. Field of the Disclosure

The present disclosure relates to a chemically prepared toner formulation for use in electrophotography, and more specifically, to a toner formulation having a crystalline polyester that is encapsulated by a styrene acrylate latex formulation and method of preparing the same. The disclosed method of preparing the toner results in a change in the distribution of the components of the toner particle wherein the lower molecular weight resins, the pigment, and the wax are located away from the surface of the toner particle.

2. Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners. There are several known types of CPT including suspension polymerization toner (SPT), emulsion aggregation toner (EAT)/latex aggregation toner (LAT), toner made from a dispersion of pre-formed polymer in solvent (DPPT) and "chemically milled" toner. While emulsion aggregation toner requires a more complex process than other CPTs, the resulting toner has a relatively narrower size distribution. Emulsion aggregation toners can also be manufactured with a smaller particle size allowing improved print resolution. The emulsion aggregation process also permits better control of the shape and structure of the toner particles that allows them to be tailored to fit the desired cleaning, doctoring and transfer properties. The shape of the toner particles may be optimized to ensure proper and efficient cleaning of the toner from various electrophotographic printer components, such as the developer roller, charge roller and doctoring blades, in order to prevent filming or unwanted deposition of toner on these components.

In a typical process for preparing EAT, emulsion aggregation is carried out in an aqueous system resulting in good control of both the size and shape of the toner particles. The toner components typically include a polymer binder, one or more colorants and a release agent. A styrene acrylic copolymer polymer binder can be used as the latex binder in the emulsion aggregation process. However, the use of a styrene acrylic copolymer latex binder requires a tradeoff between the fusing properties and shipping and storage properties of the toner. The fusing properties of the toner include its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window, the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to conserve energy. However, the toner must also be able to survive the temperature and humidity extremes associated with storage and shipping without caking or blocking which may result in print flaws. As a result, the low end of the fuse window cannot be so low that the ship store property of the toner is unacceptable, thereby melting the toner contained in the toner cartridge during shipping and storage.

Toners formed from polyester binder resins can possess better mechanical properties than toners formed from a styrene acrylic copolymer binder of similar melt viscosity characteristics, thereby making them more durable and resistant to filming of printer components. Polyester toners also have better compatibility with color pigments resulting in a wider color gamut. However, the use of polyester binder resins in toners also has limitations such as increased expense to manufacture and limiting the fusing properties of the toner. Additionally, polyester binder resins are more difficult to disperse in an aqueous system due to their polar nature, pH sensitivity and gel content thereby limiting their applicability in the emulsion aggregation process.

The inventors of the present invention believe it is possible to cost effectively produce a toner that also has the desirable low energy fusing temperature and does not degrade during shipping or storage. This is achieved by combining the advantages of both styrene acrylate and polyester resins in the toner particle. However, it is often difficult to combine these two resins because it is difficult to anchor the styrene acrylic onto the polyester resin particles in the EA toner manufacturing process, especially when the toner is formulated into a core shell structure. Another problem that arises in chemically prepared styrene acrylate, polyester, and hybrid resin based toners is the migration of waxes, lower molecular weight resins, such as crystalline polyester and short chain styrene acrylate polymer, and colorants to the surface of the toner particle. The migration of these components to the surface of the toner particle weakens the fusing and ship/store properties of the toner, and increases the occurrence of filming on printer components. Prior art methods to make chemically prepared core shell toner do not completely prevent the migration of such components to the surface of the toner particle. It would be advantageous for the toner to have the lower molecular weight resins, the pigment, and the wax to be located away from the surface of the toner particle. Moreover, a very desirous distribution of the wax and pigment in the toner particle is for the wax to accumulate into larger domains located away from the surface of the toner particle and for the pigment to accumulate on the edges of these large wax domains. This particular distribution improves the fusing, charging, ship/store properties of the toner and controls the color-to-color variation between different colored toners.

Accordingly, there is a need for an emulsion aggregation toner formulation and process that reduces the migration of lower molecular weight resins, waxes, and colorants to the surface of the toner particle. It would be desirable for the toner to have the pigment and the wax to be located away from the surface of the toner particle. Moreover, a very desirous distribution of the wax and pigment in the toner particle is for the wax to accumulate into larger domains located away from the surface of the toner particle and for the pigment to accumulate on the edges of these large wax domains. The disclosed method of preparing the toner results in this desirable distribution of the components of the toner. This desirable change in the distribution of these components in the toner particle is accomplished by first encapsulating a crystalline polyester with a styrene acrylic latex and then adding this encapsulated crystalline polyester latex to the remaining components in the toner in an emulsion aggregation process. These particular steps performed in an emulsion aggregation process surprisingly changes the distribution of the components in the toner particle, wherein the wax accumulates into larger domains located away from the surface of the toner particle and the pigment accumulates on the edges of these large wax domains. Without wishing to be bound by theory, it is believed that the functional groups in the styrene acrylic latex act as an anchor for the pigment, which in turn positively influences the pigment distribution in the toner particles. This particular arrangement reduces the likelihood of the styrene acrylic, crystalline polyester, wax or pigment migrating to the toner surface, thereby reducing the likelihood of weakening the fusing and ship/store properties of the toner, and the occurrence of filming on printer components.

SUMMARY OF THE DISCLOSURE

A method for producing toner for electrophotography that changes the distribution of the components in the toner particle, according to one embodiment, includes the first step of preparing the unique styrene acrylic encapsulated crystalline polyester latex. This is done by preparing a crystalline polyester dispersion, preparing a monomer solution, seeding the crystalline polyester dispersion with a portion of the monomer solution, and adding an initiator solution and a remaining portion of the monomer solution to the seeded crystalline polyester dispersion. Separately, a first and a second polymer emulsions as well as a pigment and a wax emulsion are prepared. The first polymer emulsion is then combined and agglomerated with the pigment and wax dispersion and the encapsulated crystalline polyester latex to form toner cores. An optional borax coupling agent is added to the toner cores once the toner cores reach a predetermined size. The second polymer emulsion is combined and agglomerated with the toner cores to form toner shells around the toner cores. The toner cores and toner shells are then fused to form toner particles.

A chemically prepared toner composition, according to one example embodiment includes a toner particle having a core including a first polymer binder, an styrene acrylic encapsulated crystalline polyester latex, a pigment, a wax, and a shell formed around the core including a second polymer binder.

BRIEF DESCRIPTION OF THE DRAWINGS

The above mentioned and other features and advantages of the various embodiments, and the manner of attaining them, will become more apparent and will be better understood by reference to the accompanying drawings.

DETAILED DESCRIPTION

Figure 1:
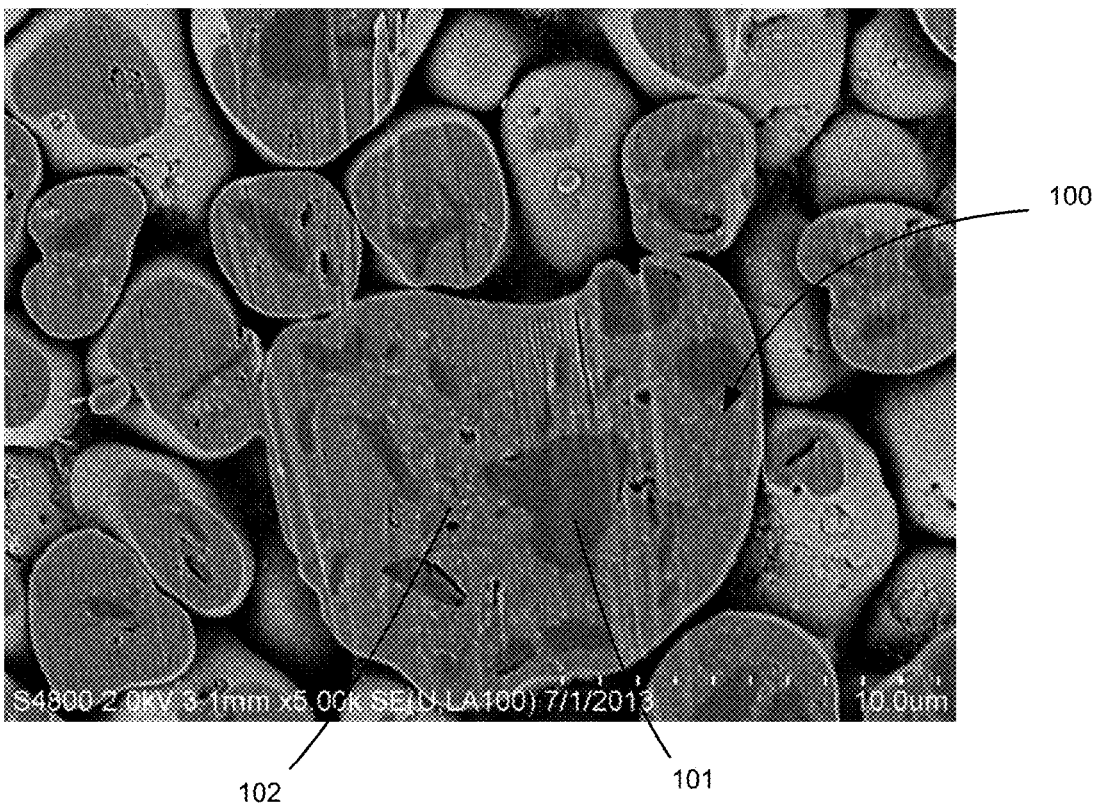
FIG. 1 is an image of a cross section of a toner particle using a scanning electron microscope showing the distribution of the wax domain and the pigment in a prior art toner particle.

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure relates to a chemically prepared core shell toner containing a styrene acrylic encapsulated crystalline polyester latex in the core and an associated emulsion aggregation method of preparation of the toner having the styrene acrylic encapsulated crystalline polyester latex in the core. The toner is utilized in an electrophotographic printer such as a printer, copier, multi-function device or an all-in-one device. The toner may be provided in a cartridge that supplies toner to the electrophotographic printer. Example methods of forming toner using emulsion aggregation techniques are found in U.S. Pat. Nos. 6,531,254 and 6,531,256, which are incorporated by reference herein in their entirety. Additionally, U.S. Pat. Nos. 8,669,035 and 9,023,569 disclose example toner formulations and methods of making toner using a borax coupling agent and are assigned to the applicants of the present invention and are incorporated by reference herein in their entirety.

In the present emulsion aggregation process, the toner particles are manufactured by chemical methods as opposed to physical methods such as pulverization. Generally, the toner includes one or more polymer binders, a styrene acrylic encapsulated crystalline polyester latex, a release agent or wax, a colorant, an optional borax coupling agent and one or more optional additives such as a charge control agent (CCA).

The encapsulation latex is a low molecular weight, low glass transition temperature (Tg), cross-linked latex. The reason that the encapsulation latex has this requirement is that the latex itself should be a low temperature fusing promoter without hurting the ship/store property of the toner and easily reach the required toner particle circularity without changing the polyester EAT process. The encapsulated crystalline polyester latex is synthesized using two steps. The first step is a crystalline polyester dispersion formation process and the second step is an encapsulation process that involves latex emulsion polymerization. A monomer solution is prepared using styrene and acrylate monomers with a crosslinking agent and chain transfer agents. An initiator solution is prepared separately in water with an inorganic base such as sodium hydroxide and a surfactant. A portion of the monomer solution is used as an organic seed and added to the crystalline polyester dispersion. The organic seed, together with the radical initiator and the crystalline polyester dispersion are held at a temperature near the melting point of the crystalline polyester for about 20 to 25 minutes. The rest of the monomer solution and the initiator solution is then added to the crystalline polyester dispersion over a period of time. The reaction is held for another 2 hours and cooled to room temperature. The resulting styrene acrylic encapsulated crystalline polyester latex is then filtered through a mesh to eliminate large grits. This resulting styrene acrylic encapsulated crystalline polyester latex is then used in the toner formulation of the present invention.

A detailed synthesis of the toner of the present invention is set forth as follows: An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A-), e.g., an anionic surfactant or an anionic polymeric dispersant may also be included. It will be appreciated that a cationic (C+) functional group, e.g., a cationic surfactant or a cationic polymeric dispersant, may be substituted as desired. The polymer latex is used at two points during the toner formation process. A first portion of the polymer latex is used together with the above described styrene acrylic encapsulated crystalline polyester latex to form the core of the resulting toner particle and a second portion of the polymer latex is used to form a shell around the toner core. The first and second portions of the polymer latex may be formed separately or together. Where the portions of the polymer latex forming the toner core and the toner shell are formed separately, either the same or different polymer binders may be used in the core and shell. In the EAT of the present invention, different polymer latexes are used for the core and shell of the toner. The ratio of the amount of polyester binder in the toner core to the amount of polyester binder in the shell is between about 20:80 (wt.) and about 80:20 (wt.) including all values and increments therebetween, such as between about 50:50 (wt.) and about 80:20 (wt.), depending on the particular polyester resin(s) used.

The styrene acrylic encapsulated crystalline polyester latex, colorant, release agent and the optional CCA are dispersed separately in their own aqueous environments or in one aqueous mixture, as desired, in the presence of a stabilizing agent having similar functionality (and ionic charge) as the stabilizing agent employed in the polymer latex. The styrene acrylic encapsulated crystalline polyester latex, polymer latex forming the toner core, the colorant dispersion, the release agent dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the polymer latex to induce the growth of clusters of the aggregate particles. Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. The toner particles are then washed and dried.

The toner particles produced may have an average particle size of between about 3 μm and about 20 μm (volume average particle size) including all values and increments therebetween, such as between about 4 μm and about 15 μm or, more particularly, between about 5 μm and about 7 μm. The toner particles produced may have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments, Ltd., Malvern, Worcestershire, UK. The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Styrene Acrylic Latex

There are several factors to consider when formulating a latex to encapsulate a crystalline polyester that will change the distribution of the components of the toner, wherein the lower molecular weight resins, the pigment, and the wax are located away from the surface of the toner particle and the wax accumulates into larger domains and the pigment accumulates on the edges of these large wax domains. Having this particular arrangement of the wax and pigment in the final toner particle positively affects the toner fusing temperature and ship/store properties. These factors include the monomer selected, the cross-linking agent, and the chain transfer agent.

Monomer Selection

The latex is formed from monomers. Hydrophobic monomers may be selected from a group including, but not limited to, styrene, butyl acrylate, lauryl acrylate, and stearyl methacrylate. Hydrophobic refers to a relatively non-polar type chemical structure that tends to self-associate in the presence of water. In one embodiment, lauryl acrylate is used with styrene. In another embodiment, butyl acrylate is used with styrene. Although longer chain lengths hydrocarbons are preferred for the interaction of the monomer with the wax and other resins in the toner, the longer the hydrocarbon chain, the less efficient the monomer is in co-polymerization. Hydrophilic monomers may be selected from carboxy (—COOH) and hydroxy (—OH) functional groups. The hydrophilic monomers also affect the agglomeration of the toner particle in the EA CPT process. Hydrophilic functionality refers to relatively polar functionality (e.g., an anionic group) which may then tend to associate with water molecules. Hydrophilic monomers provide additional stability for the latex particles apart from that already provided by the surfactant and initiator. Examples of hydrophilic monomers are hydroxyethyl methacrylate, beta-carboxyethyl acrylate. Furthermore, the quantity of the carboxy and hydroxyl functional groups in the chosen hydrophilic monomers have been found to have a great influence on the print quality and stability of the toner. Without wishing to be bound by theory, it is believed that these functional groups in the chosen monomer act as an anchor for the pigment, which in turn influences the pigment distribution in the toner particles.

Cross-Linking Agent

The cross-linking agent controls the gel content of the latex which, in turn, affects both fusing temperature and the migration of the latex polymers. A low molecular weight, low Tg latex is preferred, however, these properties are the opposite of those required to maintain the ship/store property of the toner. Surprisingly, cross-linking the low molecular weight polymer chain into a soft gel is a more favorable solution. In an embodiment, divinyl benzene is useful as a cross-linking agent. Other useful cross-linking agents include any kind of di- or multifunctional meth(acrylate).

Chain Transfer Agent

The chain transfer agent not only controls the molecular weight of the latex, but also affects the grit formation of the reaction. Generally, any kind of thiol compounds can be a possible chain transfer agent. In the present encapsulation process, two chain transfer agents are used: 1-dodecanethiol and isooctyl-3-mercaptopropionate.

Ammonium persulfate is used in the initiator solution and a surfactant such as AKYPO-M100 is used together with the organic seed. AKYPO-M100 is available from Kao Corporation, Bunka Sumida-ku, Tokyo, Japan.

A low Tg latex is preferred to encapsulate the crystalline polyester. Particularly, based on the quantity of the latex used in the toner, latex having a low molecular weight, medium cross-linking and a Tg between about 20° C. to about 60° C. is preferred in order to achieve the desirable energy efficient toner making and low temperature fusing of 175° C. or lower. An embodiment uses a latex having a Tg between 40° C. to 50° C. In some embodiments, the encapsulated crystalline polyester latex portion can be up to 25% wt of the total latex. In an embodiment, the encapsulated crystalline polyester latex is about 20% wt of the total latex.

As mentioned above, the toners herein include one or more polymer binders. The terms resin and polymer are used interchangeably herein as there is no technical difference between the two. In one embodiment, the polymer binder(s) include polyesters. The polyester binder(s) may include a semi-crystalline polyester binder, a crystalline polyester binder or an amorphous polyester binder. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example polyester resins include, but are not limited to, T100, TF-104, NE-1582, NE-701, NE-2141, NE-1569, Binder C, FPESL-2, W-85N, TL-17, TPESL-10, TPESL-11 polyester resins from Kao Corporation, Bunka Sumida-ku, Tokyo, Japan, or mixtures thereof. The polymer binder(s) also includes a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacrylate copolymer and/or polymers made from styrene-butyl acrylate and other acrylic monomers such as hydroxy acrylates or hydroxyl methacrylates); polyvinyl acetate, polyalkenes, poly(vinyl chloride), polyurethanes, polyamides, silicones, epoxy resins, or phenolic resins. Various commercially available crystalline polyester resin emulsions are available from Kao Corporation, Bunka Sumida-ku, Tokyo, Japan and Reichhold Chemical Company, Durham, N.C. under the trade names EPC 2-20, EPC 3-20, 6-20, 7-20, CPES B1, EPC 8-20, EPC 9-20, EPC-10-20, CPES B20 and CPES B25.

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments therebetween. For example, the colorant may be present in the dispersion at a level of about 10% to about 15% by weight. The dispersion of colorant may contain particles at a size of about 50 nanometers (nm) to about 500 nm including all values and increments therebetween. Further, the colorant dispersion may have a pigment weight percent divided by dispersant weight percent (P/D ratio) of about 1:1 to about 8:1 including all values and increments therebetween, such as about 2:1 to about 5:1. The colorant may be present at less than or equal to about 15% by weight of the final toner formulation including all values and increments therebetween.

The optional coupling agent used herein is borax (also known as sodium borate, sodium tetraborate, or disodium tetraborate). As used herein, the term borax coupling agent is defined as enabling the formation of hydrogen bonds between polymer chains which assists in the anchoring or binding of the polymer found in the shell onto the surface of the toner core containing the polymers or mixture of polymers, thereby helping to couple the shell to the outer surface of the toner core. The borax coupling agent bonds the shell to the outer surface of the core by forming hydrogen bonding between its hydroxyl groups and the functional groups present in the polymers utilized in the inventive toner formulation.

Typically, coupling agents have multivalent bonding ability. Borax differs from commonly used permanent coupling agents, such as multivalent metal ions (e.g., aluminumand zinc), in that its bonding is reversible. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxy groups and the functional groups of the molecules it is bonded to. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

The wax used may include any compound that facilitates the release of toner from a component in an electrophotographic printer (e.g., release from a roller surface). The term 'release agent' can also be used to describe a compound that facilitates the release of toner from a component in an electrophotographic printer. For example, the release agent or wax may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters or mixtures thereof.

The wax or release agent may therefore include a low molecular weight hydrocarbon based polymer (e.g., Mn≤10,000) having a melting point of less than about 140° C. including all values and increments between about 50° C. and about 140° C. The wax may be present in the dispersion at an amount of about 5% to about 35% by weight including all values and increments there between. For example, the wax may be present in the dispersion at an amount of about 10% to about 18% by weight. The wax dispersion may also contain particles at a size of about 50 nm to about 1 μm including all values and increments there between. In addition, the wax dispersion may be further characterized as having a wax weight percent divided by dispersant weight percent (RA/D ratio) of about 1:1 to about 30:1. For example, the RA/D ratio may be about 3:1 to about 8:1. The wax is provided in the range of about 2% to about 20% by weight of the final toner formulation including all values and increments there between. Exemplary waxes having these above enumerated characteristics include, but are not limited to, SD-A01, SD-B01, MPA-A02, CM-A01 and CM-B01 from Cytech Products, Inc., Polywax M70, Polywax M80 and Polywax 500 from Baker Petrolite and WE5 from Nippon Oil and Fat.

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. No. 6,991,884 and U.S. Pat. No. 5,714,538, which are assigned to the assignee of the present application and are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, extra particular additives, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof.

The following examples are provided to further illustrate the teachings of the present disclosure, not to limit the scope of the present disclosure.

Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Wax Emulsion 1

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 12 g of ester wax and 48 g of paraffin wax from Cytec Products Inc., Elizabethtown, Ky. was added to the hot mixture while the temperature was maintained at about 90° C. for about 15 minutes. The emulsion was then removed from the microfluidizer when the particle size was below about 250 nm.

The solution was then stirred at room temperature. The wax emulsion was set to contain about 15% to about 25% solids by weight Example Wax Emulsion 2

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 60 g of polyethylene wax from Baker Petrolite, Corp., Westlake, Ohio, USA was slowly added while the temperature was maintained at about 90° C. for about 15 minutes. The emulsion was then removed from the microfluidizer when the particle size was below about 300 nm. The solution was then stirred at room temperature. The wax emulsion was set to contain about 15% to about 25% solids by weight. This method can be used to disperse all other types of wax that fall into the melting range described in this disclosure.

Example Polyester Resin Emulsion A

A polyester resin having a peak molecular weight of about 11,000, a glass transition temperature (Tg) of about 55° C. to about 58° C., a melt temperature (Tm) of about 115° C., and an acid value of about 8 to about 13 was used. The glass transition temperature is measured by differential scanning calorimetry (DSC), wherein, in this case, the onset of the shift in baseline (heat capacity) thereby indicates that the Tg may occur at about 55° C. to about 58° C. at a heating rate of about 5 per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 7 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles. The particle size of Polyester Resin Emulsion A was between about 190 nm and about 240 nm (volume average) as measured by a NANOTRAC Particle Size Analyzer. The pH of the resin solution was between about 7.5 and about 8.2.

Example Polyester Resin Emulsion B

A polyester resin having a peak molecular weight of about 15K, a glass transition temperature of about 59° C. to about 63° C., a melt temperature of about 119° C., and an acid value of about 20 to 21 was used to form an emulsion using the procedure outlines above to make example Polyester Resin Emulsion A. The particle size of Polyester Resin Emulsion B was between about 190 nm and about 240 nm (volume average) as measured by a NANOTRAC Particle Size Analyzer. The pH of the resin solution was between about 7.5 and about 8.5.

Example Crystalline Polyester Resin Emulsion

A crystalline polyester resin having a glass transition temperature of about 82° C. a melt temperature of about 82° C., and an acid value of about 15 to about 18 was used to form an emulsion.

125 g of the crystalline polyester resin was dissolved in 375 g of tetrahydrofuran (THF) in a round bottom flask with heat and stirring. The dissolved resin was then poured into a beaker. The beaker was placed under a homogenizer. The homogenizer was turned on at high shear and 17 g of 10% potassium hydroxide (KOH) solution and 400 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 60° C. to ensure that substantially all of the THF was distilled out. The heat to the reactor was then turned off and the mixture was stirred until it reached room temperature. Once the reactor reached room temperature, the vacuum was turned off and the resin solution was removed and placed in storage bottles. The particle size of the Crystalline Polyester Resin Emulsion was between about 185 nm and about 235 nm (volume average) as measured by a NANOTRAC Particle Size Analyzer. The pH of the resin solution was between about 8.6.

Example Styrene Acrylic Encapsulated Crystalline Polyester Latex 1

About 4.48 g of 2-hydroxyethyl methacrylate, about 107 g styrene, about 35 g lauryl acrylate, and about 2.57 g beta-carboxyethyl acrylate was mixed with about 2.2 g divinylbenzene, about 1.9276 g 1-dodecanethiol, and about 1.9082 g isooctyl-3-mercaptopropionate to form an organic monomer solution. About 7.66 g of the organic monomer solution was weighed out to be used as an organic seed.

The initiator solution is prepared in another flask with 70 g of deionized water, 0.3 g of ammonium persulfate, 9.1 g of 15% AKYPO-M100 from Kao Corporation, Bunka Sumida-ku, Tokyo, Japan, and 2.8 g of ammonium hydroxide.

In a 3 Liter four neck round bottom flask, equipped with thermocontroler, condenser, mechanical stirrer and nitrogen inlet, 300 g Deionized water, 177 g of the Example Crystalline Polyester Emulsion (with 21.6% crystalline polyester (CPE)) and 1.0 g of 15% Akypo-M100 from Kao Corporation, Bunka Sumida-ku, Tokyo, Japan, and 2.0 g of ammonium hydroxide solution were charged and heated to 82° C. At 82° C., the organic seed with 0.11 g ammonium persulfate were added and held for 25 minutes. Then the organic and initiator portion were added drop-wise to the reactor while maintaining the temperature at 82° C. The addition takes about 1-2 hours. At about four hours, 0.19 g of t-butylhydroperoxide and 0.13 g of L-ascorbic acid in 25 ml of de-ionized water were added separately to the reactor. The reaction was held for another 2 hours and cooled down to room temperature. The product was filtered through a mesh to eliminate large particles so that it could be used in the toner agglomeration process. The final particle size is about 140 nm.

Example Styrene Acrylic Encapsulated Crystalline Polyester Latex 2

About 4.48 g of 2-hydroxyethyl methacrylate, about 100 g styrene, about 38 g butyl acrylate, and about 2.57 g beta-carboxyethyl acrylate was mixed with about 2.2 g divinylbenzene, about 1.9276 g 1-dodecanethiol, and about 1.9082 g isooctyl-3-mercaptopropionate to form an organic monomer solution. About 7.66 g of the organic monomer solution was weighed out to be used as an organic seed.

The initiator solution is prepared in another flask with 70 g of deionized water, 0.3 g of ammonium persulfate, 9.1 g of 15% Akypo-M100 from Kao Corporation, Bunka Sumida-ku, Tokyo, Japan, and 2.8 g of ammonium hydroxide. In a 3 Liter four neck round bottom flask, equipped with thermocontroler, condenser, mechanical stirrer and nitrogen inlet, 300 g Deionized water, 177 g of the Example Crystalline Polyester Emulsion (with 21.6% CPE) and 1.0 g of 15% Akypo-M100 from Kao Corporation, Bunka Sumida-ku, Tokyo, Japan, and 2.0 g of ammonium hydroxide solution were charged and heated to 82° C. At 82° C., the organic seed with 0.11 g ammonium persulfate were added and held for 25 minutes. Then the organic and initiator portion were added drop-wise to the reactor while maintaining the temperature at 82° C. The addition takes about 1-2 hours. At about four hours, 0.19 g of t-butylhydroperoxide and 0.13 g of L-ascorbic acid in 25 ml of de-ionized water were added separately to the reactor. The reaction was held for another 2 hours and cooled down to room temperature. The product was filtered through a mesh to eliminate large particles so that it could be used in the toner agglomeration process. The final particle size is about 116 nm.

TONER FORMULATION EXAMPLES

Example Toner 1

Example Styrene Acrylic Encapsulated Crystalline Polyester Latex 1 (containing about 9.6 g crystalline polyester and about 38.4 g styrene-acrylate resin) was mixed in a reactor with the Example Polyester Emulsion A (containing about 120 g resin), Example Cyan Pigment Dispersion (containing about 15.3 g of pigment), Example Wax Emulsion 1 (containing about 42 g wax), and 810 g deionized water. The mixture was heated in the reactor to 22° C. and a circulation loop was started, consisting of a high shear mixer and an acid addition pump. The mixture was sent through the loop and the high shear mixer was set at 10,000 revolutions per minute (rpm). Acid was slowly added to the high shear mixer to evenly disperse the acid in the toner mixture so that there are no pockets of low pH. Adding about 210 g of a 1% sulfuric acid solution took about 4 minutes. The flow of the loop was then reversed to return the toner mixture to the reactor. The temperature of the reactor was then raised to about 40° C.-45° C. Once particle size has reached 4 μm (number average), 5% (wt) borax solution (about 30 g of solution having about 1.5 g of borax) was added. After the addition of borax, the Example Polyester Emulsion B (containing 72 g resin), was added. The mixture was stirred for about 5 minutes while monitoring pH. Once the particle size reached about 5.5 μm (number average), 4% NaOH was added to raise the pH to about 6.95 to stop particle growth. The reaction temperature was then held for about one hour, and the particle size was monitored. Once particle growth stopped, the temperature was increased to about 92° C. to cause the particles to coalesce. This temperature was maintained until the particles reached a desired circularity of about 0.97. The resulting toner was then cooled, washed, and dried.

The dried toner had a number particle size of 5.55 μm, measured by a COULTER COUNTER Multisizer 3 analyzer. Fines (<2 μm) were present at 1.27% (by number) and the toner possessed a circularity of 0.978, both measured by the SYSMEX FPIA-3000 particle characterization analyzer, manufactured by Malvern Instruments, Ltd., Malvern, Worcestershire UK.

Example Toner 2

Example Styrene Acrylic Encapsulated Crystalline Polyester Latex 2 (containing about 9.6 g crystalline polyester and about 38.4 g styrene-acrylate resin) was mixed in a reactor with the Example Polyester Emulsion A (containing about 120 g resin), Example Cyan Pigment Dispersion (containing about 15.3 g of pigment), Example Wax Emulsion 1 (containing about 42 g wax), and 810 g deionized water. The mixture was heated in the reactor to 22° C. and a circulation loop was started, consisting of a high shear mixer and an acid addition pump. The mixture was sent through the loop and the high shear mixer was set at 10,000 revolutions per minute (rpm). Acid was slowly added to the high shear mixer to evenly disperse the acid in the toner mixture so that there are no pockets of low pH. Adding about 210 g of a 1% sulfuric acid solution took about 4 minutes. The flow of the loop was then reversed to return the toner mixture to the reactor. The temperature of the reactor was then raised to about 40° C.-45° C. Once particle size has reached 4 μm (number average), 5% (wt) borax solution (about 30 g of solution having about 1.5 g of borax) was added. After the addition of borax, the Example Polyester Emulsion B (containing 72 g resin), was added. The mixture was stirred for about 5 minutes while monitoring pH. Once the particle size reached about 5.5 μm (number average), 4% NaOH was added to raise the pH to about 6.95 to stop particle growth. The reaction temperature was then held for about one hour, and the particle size was monitored. Once particle growth stopped, the temperature was increased to about 92° C. to cause the particles to coalesce. This temperature was maintained until the particles reached a desired circularity of about 0.97. The resulting toner was then cooled, washed, and dried.

The dried toner had a number particle size of 5.22 μm, measured by a COULTER COUNTER Multisizer 3 analyzer. Fines (<2 μm) were present at 2.54% (by number) and the toner possessed a circularity of 0.978, both measured by the SYSMEX FPIA-3000 particle characterization analyzer, manufactured by Malvern Instruments, Ltd., Malvern, Worcestershire UK.

Control Toner 1

The Example Crystalline Polyester Resin Emulsion, the Example Polyester Resin Emulsion A and the Example Polyester Resin Emulsion B are used in a ratio of 5:55:40 (wt), with a core to shell ratio of 60:40 (wt.). The Example Crystalline Polyester Emulsion is combined with the Example Polyester Resin Emulsion A to form the core while the Example Polyester Resin Emulsion B forms the shell. Components were added to a 2.5 liter reactor in the following relative proportions: 4 parts (polyester by weight) of the Example Crystalline Polyester Emulsion, 44 parts (polyester by weight) of the Example Polyester Resin Emulsion A, 5.1 parts (pigment by weight) of the Example Cyan Pigment Dispersion, 14.2 parts (release agent by weight) of the Example Wax Emulsion 2. Deionized water is then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 210 g of 1% sulfuric acid solution. The flow of the loop was then reversed to return the toner mixture to the reactor and the temperature of the reactor was increased to about 40° C.-45° C. Once the particle size reached 4.05 μm to 5.0 μm (number average), 5% (wt.) borax solution (20 g of solution having 1.0 g of borax) was added. After the addition of borax, 32 parts (polyester by weight) of the Example Polyester Resin Emulsion B was added to form the shell. The mixture was stirred for about 5 minutes and the pH was monitored. Once the particle size reached 5.5 μm (number average), 4% NaOH was added to raise the pH to about 6.89 to stop the particle growth. The reaction temperature was held for one hour. The particle size was monitored during this time period. Once particle growth stopped, the temperature was increased to 82° C. to cause the particles to coalesce. This temperature was maintained until the particles reached their desired circularity (about 0.97). The toner was then washed and dried.

The dried toner had a number average particle size of 5.28 μm. measured by a COULTER COUNTER Multisizer 3 analyzer and a Fines (<2 μm) were present at 0.50% (by number) and the toner possessed a circularity of 0.985, both measured by the SYSMEX FPIA-3000 particle characterization analyzer, manufactured by Malvern Instruments, Ltd., Malvern, Worcestershire UK.

FIG. 1 is a cross section of the toner particle from Control Toner 1 made without a styrene acrylic encapsulated crystalline polyester latex. It can be seen form a review of the cross section in FIG. 1 that the wax domains 101 in toner particle 100 are small and distributed evenly throughout the toner particle 100, with a small number of wax domains 101 lying close to the surface of the toner particle 100. Further, the pigment particles 102 (white specks) are also distributed evenly within the toner particle 100. This is not a desirable distribution of the wax domain and the pigment components in the toner particle.

Figure 2:
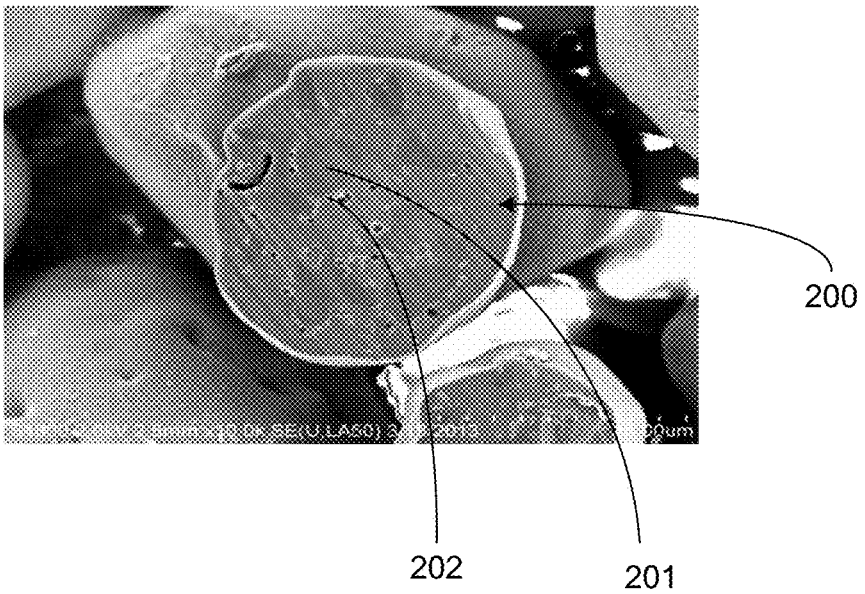
FIG. 2 is an image of a cross section of a toner particle using a scanning electron microscope showing the distribution of the wax domain and the pigment in a toner particle having a crystalline polyester resin encapsulated with a styrene acrylic latex.

In comparison, FIG. 2 shows a cross section of a toner particle 200 of Example Toner 1 that was formed using a styrene acrylic encapsulated crystalline polyester latex. In toner particle 200, it has been found that if the low Tg, low molecular weight and high cross-linking styrene acrylic is formed in the presence of the crystalline polyester, surprisingly the styrene acrylic has the ability to accumulate the wax into larger domains 201 in toner particle 200. Furthermore, FIG. 2 also shows that pigment particles (white specks) 202 tend to accumulate around the edges of the wax domains 201. Use of the crystalline polyester that is encapsulated by a styrene acrylate latex formulation in the toner formulation changes the distribution of the components in the toner, resulting in toner particle 200 where the components most likely to cause filming are constrained to substantially the center of toner particle 200. This desirable distribution of the toner components reduces the likelihood of the wax or pigment migrating to the surface of toner particle 200.

Fusing Results

Each toner formulation was printed (but not fused) with toner coverage of 1.1 mg/cm2 on 24# Hammermill laser paper. The unfused sheet was then passed through a fusing robot at 60 ppm with varying heater set point temperatures at 5° C. intervals. For the scratch resistance test, the fused print samples were evaluated using a TABER ABRADER device from TABER Industries, North Tonawanda, N.Y., USA. The printed samples were evaluated on the TABER ABRADER scale from 0 to 10 (where a rating of 10 indicates the most scratch resistance). The TABER ABRADER device scratches the printed samples multiple times with different forces until the toner is scratched off the sample. The point at which the toner is scratched off corresponds with a number rating between 0 and 10 on the TABER ABRADER scale. A tape lift-off test is carried out on 100% coverage prints on 24 pound paper. The test consists of carefully tearing off a 2" piece of transparent tape applied to the printed area and then measuring the optical density of the removed tape (using the TOBIAS IQ150 meter) in three locations on each tape sample and averaging the results. The minimum acceptable fusing temperature is the lowest temperature in which the toner sample is considered acceptable for both of the two tests described above. Example Toner 1 and Control Toner 1 both fused at a desirable energy efficient low temperature of 165° F.

Ship/Store Results

The ship/store test involves using 8 gm of finished toner placed in a container with a 75 gm load placed over it. The system is then subjected a temperature of 50° C. for 48 hrs. The sample is removed from the heat and torque is measured using a probe. Toners that remain low in cohesion are categorized as passing the test. The temperature can also be increased to 52° C. to create a stress test to differentiate our top toner candidates. Ship/store is determined at 50° C. using a 78 g load for 48 hours, and a result below 60 is acceptable. An acceptable low fusing temperature for a CPT is 180-190° C. or below.

TABLE 1

| Toner | Ship/ Store | % CPE | Acceptable Low Fusing Temperature |
|---|---|---|---|
| Control Toner 1 | 58.6 | 4 | 165° C. |
| Example Toner 1 | 55.9 | 3.2 | 170° C. |
| Example Toner 2 | 51.1 | 3.2 | 170° C. |

Table 1 shows the ship/store results from testing Control Toner 1 and Example Toners 1 and 2. Table 1 also shows the total percentage of crystalline polyester in each of these 3 toner formulations Table 1 shows the ship/store score of Example Toner 1 as having a 41% improvement compared to the ship/store score of Control Toner 1. Example Toner 2 exhibited a 46% improvement in the ship/store score compared to Control Toner 1. These test results show that the ship store property of a toner can be markedly improved by incorporating a crystalline polyester that is encapsulated by a styrene acrylate latex into the toner formulation. Additionally, Example Toners 1 and 2 are made with 16% of styrene acrylate latex to replace polyester and reduced the shell layer from 40% resin to 30% through the control of the distribution of crystalline polyester, wax and pigment, and with less crystalline polyester, thereby making them a cost effective alternative to the Control Toner 1 while having comparable fusing temperatures and ship store properties.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A method of producing toner comprising:

preparing a latex to encapsulate a crystalline polyester, the preparing of the latex including the steps of:

(a) preparing a crystalline polyester dispersion;

(b) preparing a monomer solution;

(c) seeding the crystalline polyester dispersion with a portion of the monomer solution;

(d) preparing an initiator solution; and (e) adding the initiator solution and a remaining portion of the monomer solution to the seeded crystalline polyester dispersion, wherein a polymer encapsulated crystalline polyester latex is formed;

preparing a first polymer emulsion;

preparing a second polymer emulsion;

preparing a wax emulsion;

preparing a pigment dispersion;

combining and agglomerating the first polymer emulsion with the pigment dispersion, wax emulsion and the polymer encapsulated crystalline polyester latex to form toner cores;

combining and agglomerating the second polymer emulsion with the toner cores to form toner shells around the toner cores; and fusing the aggregated toner cores and toner shells to form toner particles, wherein the monomer solution includes a hydrophilic monomer having one of a carboxyl (—COOH) functional group and a hydroxy (—OH) functional group and hydrophobic styrene and acrylate monomers and wherein the hydrophilic monomer having one of a carboxyl (—COOH) functional group and a hydroxy (—OH) functional group is at least one of hydroxyethyl methacrylate and beta-carboxyethyl acrylate.

2. The method of claim 1, wherein the hydrophobic acrylate monomer is an alkyl acrylate.

3. The method of claim 2, wherein the alkyl acrylate monomer is butyl acrylate.

4. The method of claim 2, wherein the alkyl acrylate monomer is lauryl acrylate.

5. The method of claim 1, wherein the glass transition temperature (Tg) of the latex is between 20° C. and 60° C.

6. The method of claim 1, wherein the first polymer emulsion and the second polymer emulsion each include a polyester resin.

7. The method of claim 1, further comprising the step of adding a borax coupling agent to the surface of the formed toner cores and then performing the step of combining and agglomerating the second polymer emulsion with the formed toner cores having the borax coupling agent on its surface to form toner shells around the toner cores.

8. A method of producing toner comprising:

preparing a latex to encapsulate a crystalline polyester, the preparing of the latex including the steps of:

(a) preparing a crystalline polyester dispersion;

(b) preparing a monomer solution;

(c) seeding the crystalline polyester dispersion with a portion of the monomer solution;

(d) preparing an initiator solution; and (e) adding the initiator solution and a remaining portion of the monomer solution to the seeded crystalline polyester dispersion, wherein a polymer encapsulated crystalline polyester latex is formed;

preparing a first polymer emulsion;

preparing a second polymer emulsion;

preparing a wax emulsion;

preparing a pigment dispersion;

combining the first polymer emulsion with the pigment dispersion, wax emulsion and the polymer encapsulated crystalline polyester latex to form toner cores;

adjusting the pH of the combination of the first polymer emulsion with the pigment dispersion, the wax emulsion and the polymer encapsulated crystalline polyester latex to promote agglomeration of the toner cores;

combining and agglomerating the second polymer emulsion with the toner cores to form toner shells around the toner cores;

once a desired toner particle size between about 4 μm and about 15 μm is reached, adjusting the pH of the mixture of the aggregated toner cores and toner shells to prevent additional particle growth; and fusing the aggregated toner cores and toner shells to form toner particles, wherein the monomer solution includes a hydrophilic monomer having one of a carboxyl (—COOH) functional group and a hydroxy (—OH) functional group and hydrophobic styrene and acrylate monomers and wherein the hydrophilic monomer having one of a carboxyl (—COOH) functional group and a hydroxy (—OH) functional group is at least one of hydroxyethyl methacrylate and beta-carboxyethyl acrylate.

9. The method of claim 8, wherein the hydrophobic acrylate monomer is an alkyl acrylate.

10. The method of claim 9, wherein the alkyl acrylate monomer is butyl acrylate.

11. The method of claim 9, wherein the alkyl acrylate monomer is lauryl acrylate.

12. The method of claim 8, wherein the first polymer emulsion and the second polymer emulsion each include a polyester resin.

13. The method of claim 8, further comprising the step of adding a borax coupling agent to the surface of the formed toner cores and then performing the step of combining and agglomerating the second polymer emulsion with the formed toner cores having the borax coupling agent on its surface to form toner shells around the toner cores.

* * * * *